US011702829B2

(12) United States Patent
Ahuja et al.

(10) Patent No.: US 11,702,829 B2
(45) Date of Patent: Jul. 18, 2023

(54) KITS FOR REDUCING INVENTORY OF SINK DRAIN ASSEMBLIES

(71) Applicant: PF Waterworks LP, Houston, TX (US)

(72) Inventors: Sanjay Ahuja, Katy, TX (US); Harold Kent Beck, Copper Canyon, TX (US)

(73) Assignee: PF Waterworks LP, Houston, TX (US)

( * ) Notice: Subject to any disclaimer, the term of this patent is extended or adjusted under 35 U.S.C. 154(b) by 174 days.

(21) Appl. No.: 17/141,605

(22) Filed: Jan. 5, 2021

(65) Prior Publication Data

US 2021/0207351 A1 Jul. 8, 2021

Related U.S. Application Data

(60) Provisional application No. 62/958,363, filed on Jan. 8, 2020.

(51) Int. Cl.
*E03C 1/23* (2006.01)

(52) U.S. Cl.
CPC ..... *E03C 1/2302* (2013.01); *E03C 1/2306* (2013.01)

(58) Field of Classification Search
CPC ..... E03C 1/2302; E03C 1/2306; E03C 1/232; E03C 1/23; E03C 1/22
See application file for complete search history.

(56) References Cited

U.S. PATENT DOCUMENTS 3,220,695 A 11/1965 Downey et al.
3,366,980 A 2/1968 Petursson et al.
3,428,295 A 2/1969 Downey et al.
3,453,667 A 7/1969 Politz
4,007,500 A 2/1977 Thompson et al.
4,381,569 A 5/1983 Ingram
4,432,565 A 2/1984 Ohannesian et al.
4,807,306 A 2/1989 Hayman et al.
7,320,336 B2 1/2008 Herring et al.
10,240,329 B2 3/2019 Beck et al.
10,301,803 B2 5/2019 Beck et al.
10,808,386 B2 10/2020 Beck et al.
2006/0108558 A1* 5/2006 Wooldridge ..... E03C 1/22 251/344
2010/0180966 A1 7/2010 George
2011/0138527 A1 6/2011 Sienna et al.
2013/0042398 A1 2/2013 McLeod
2013/0227780 A1 9/2013 Thommelin et al.
(Continued)

*Primary Examiner* — Janie M Loeppke
(74) *Attorney, Agent, or Firm* — Stephen S. Hodgson

(57) ABSTRACT

A method is provided for a plumbing parts supplier to reduce inventory of sink drain assemblies. Drain assemblies for overflow-type sinks have an overflow port, while drain assemblies for vessel sinks do not. Some drain assemblies have open and closed positions, while a grid drain or an umbrella drain does not. A drain assembly may be available in different finishes. Rather than having an inventory of drain assemblies for all possible applications, kits are provided that allow an end-user to assemble one of two or more drain assemblies. One kit includes a drain assembly for an overflow-type sink and a sleeve that fits in the drain assembly and covers an overflow port. Other kits include a drain assembly with a push-type open-close mechanism and means for keeping the drain assembly in the open position. Another kit includes a push-button drain assembly with an overflow port, means for converting it an umbrella drain and a sleeve for covering the overflow port.

23 Claims, 10 Drawing Sheets

(56) References Cited

U.S. PATENT DOCUMENTS

| | | | | |
|---|---|---|---|---|
| 2013/0269100 | A1 | 10/2013 | Ball et al. | |
| 2014/0000022 | A1* | 1/2014 | McLeod | E03C 1/22 4/652 |
| 2016/0130793 | A1 | 5/2016 | Lesmeister | |
| 2016/0208470 | A1 | 7/2016 | Franke | |
| 2017/0204592 | A1 | 7/2017 | Chen | |
| 2018/0263426 | A1* | 9/2018 | Ahuja | E03C 1/2306 |
| 2019/0003164 | A1* | 1/2019 | Beck | E03C 1/182 |
| 2019/0167043 | A1 | 6/2019 | Beck et al. | |

* cited by examiner

FIG.4B
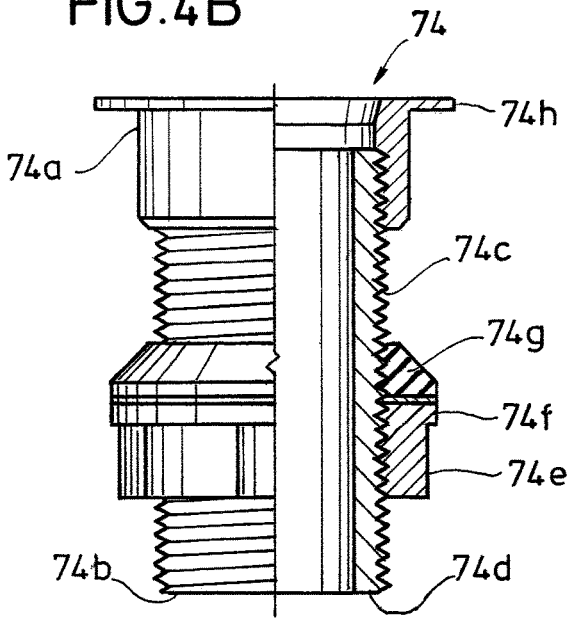
FIG.4C
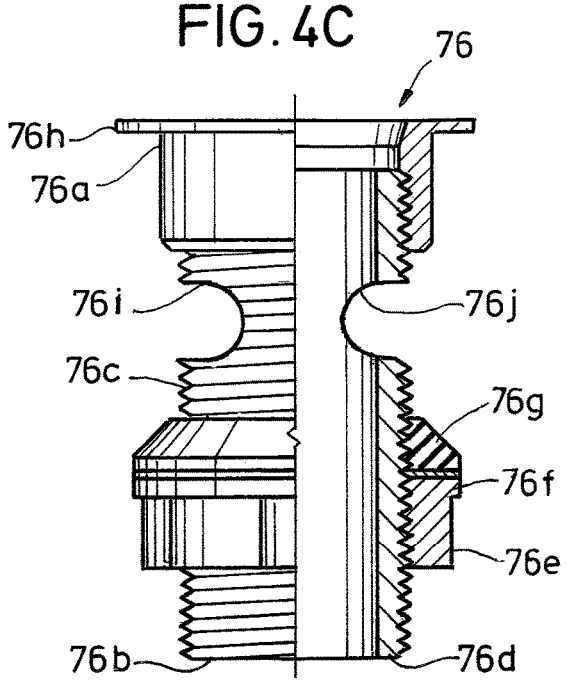
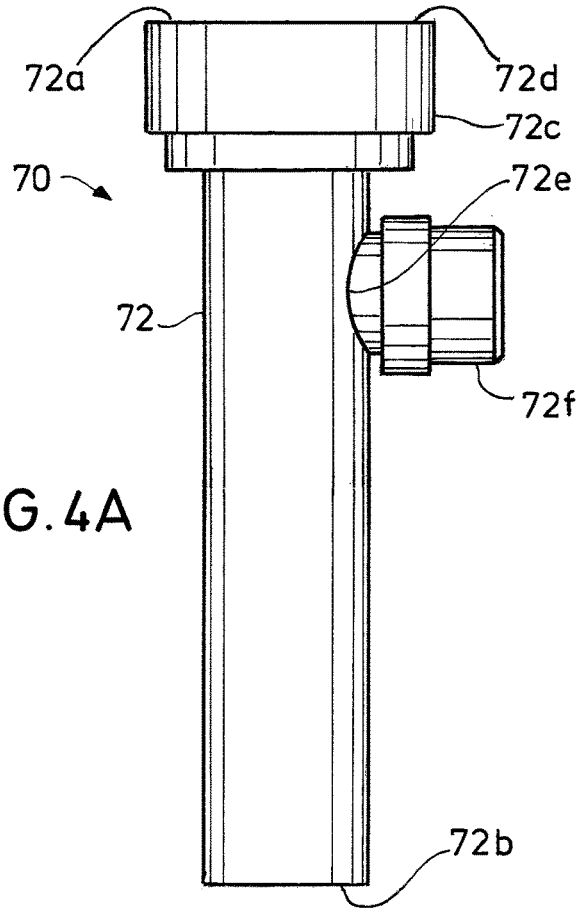
FIG.4A

KITS FOR REDUCING INVENTORY OF SINK DRAIN ASSEMBLIES

CROSS REFERENCE TO RELATED APPLICATIONS

This application claims priority to and the benefit of U.S. Provisional Patent Application Ser. No. 62/958,363, filed Jan. 8, 2020, which is incorporated by reference. This application is related to the present inventors' U.S. patent application Ser. No. 16/018,308, filed Jun. 26, 2018; Ser. No. 15/913,452, filed Mar. 6, 2018; Ser. No. 15/584,027, filed May 2, 2017; and Ser. No. 15/584,030, filed May 2, 2017, each of which is incorporated by reference.

BACKGROUND OF THE INVENTION

1. Field of the Invention

This present invention pertains to a drain assembly that attaches to a sink at a drain opening for draining water from the sink and more particularly to converting a drain assembly with an overflow port to operate with a sink that does not have an overflow channel and for converting a push-type drain assembly to always be in its open position.

2. Description of the Related Art

One type of sink that is used in a bathroom or restroom has an overflow port in the sink for diverting water into a drain assembly below a drain opening in the sink in the event the drain opening is closed while water continues to run into the sink. The drain assembly has an overflow port, and an overflow conduit, which is typically built into the sink, allows water to flow from the sink's overflow port to the drain assembly's overflow port and into the drain assembly. Another type of sink, which is known as a vessel sink, does not have an overflow port. A drain assembly that does not have an overflow port is used for the vessel sink. Retail stores and plumbing supply businesses may keep an inventory of each type of drain assembly in various finishes, which requires a considerable investment in inventory and in space for the inventory.

Another issue related to inventory and space is that some sinks are fitted with a push-type drain assembly, which has an open position and a closed position, while other sinks are fitted with an umbrella drain assembly, which has only an open position. Each of these types of drain assemblies may or may not have an overflow port. Each type of drain assembly is provided in various finishes. Retail stores and plumbing supply businesses may keep an inventory of each type of drain assembly with and without overflow ports and in the various finishes, which requires a considerable investment in inventory and space. It is desirable to reduce inventory and space for retail display as well as for storage.

SUMMARY OF THE INVENTION

Drain assemblies can include a push-type or pop-up drain valve assembly that has open and closed positions or an umbrella cap or a grid cap that has only an open position. Drain assemblies include drain bodies that may or may not have overflow ports. Drain assemblies come in multiple different finishes. Kits are provided for converting a push-button drain assembly, which has open and closed positions, to an umbrella drain assembly, which has only an open position. The kits include one or more of a sleeve or a C-clip that prevents an open-close mechanism from moving into a closed position, a solid cap that replaces an annular cap and covers a push-button, which does not allow one to engage an open-close mechanism while installed, and a cap cover that slips over an annular cap and prevents one from pushing a push-button. A kit is provided for converting a drain assembly that has an overflow port for use with a sink that does not have an overflow channel, where the kit includes a sleeve that is inserted inside the drain assembly for covering the overflow port. A kit can include means for converting a push-button drain assembly to an umbrella drain assembly and a sleeve for covering an overflow port. The kits allow a retailer or plumbing supply house to reduce inventory, display space and storage space because one drain assembly can be converted to satisfy different requirements.

The present invention provides a method for a plumbing parts supplier to reduce inventory and increase profitability. The method comprises the steps of selling a kit, which includes a sink drain assembly for a first application and means for converting the drain assembly to operate in a second application, and eliminating from inventory a second drain assembly made specifically for the second application.

BRIEF DESCRIPTION OF THE DRAWINGS

A better understanding of the invention can be obtained when the detailed description of exemplary embodiments set forth below is considered in conjunction with the attached drawings, which are described as follows.

FIGS. 4A-4C are partial cross-sections of side elevations of a pop-up drain assembly kit that includes a drain flange and an extension without an overflow port, a drain flange and an extension with overflow ports and a tailpiece, according to the present invention.

DETAILED DESCRIPTION OF THE EXEMPLARY EMBODIMENTS

Figure 1:
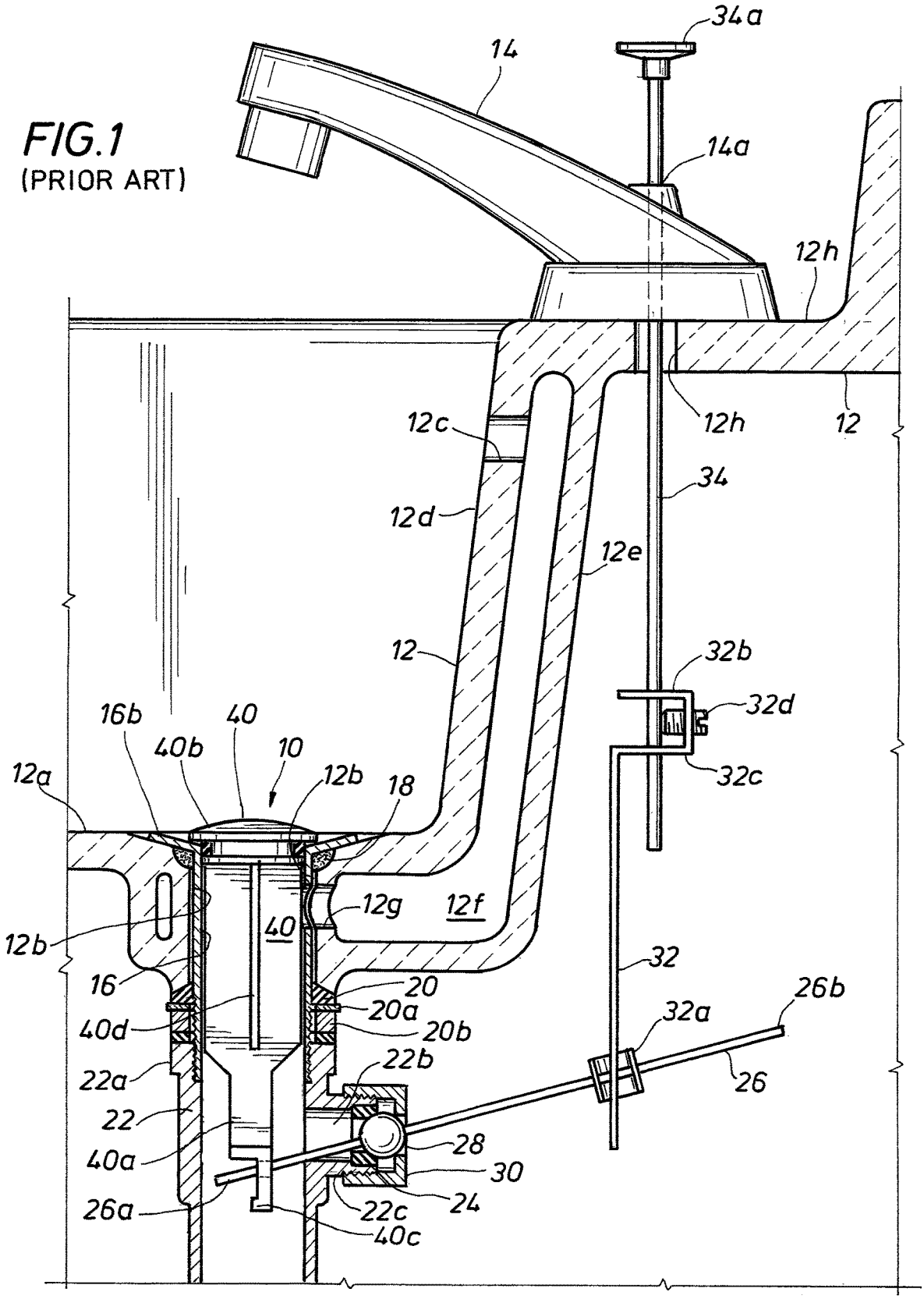
FIG.1 (PRIOR ART)
FIG. 1 is a cross-section of a side elevation of a sink with an overflow port and a drain pipe with an overflow port in fluid communication with the overflow port of the sink, according to the prior art.
Figure 2:
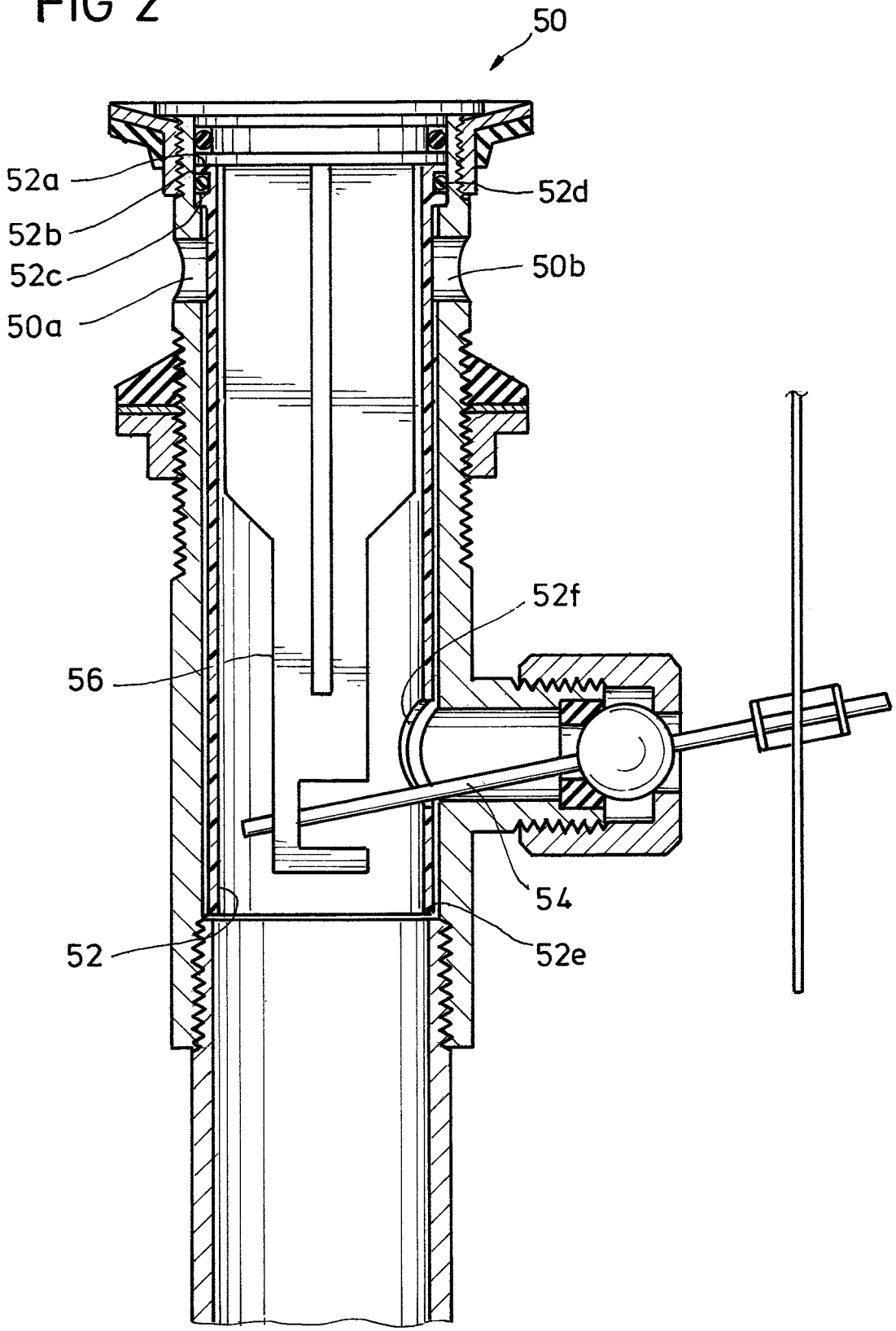
FIG. 2 is a cross-section of a side elevation of a pop-up drain assembly with overflow ports and an internal sleeve covering the overflow ports, according to the present invention.

A discussion of the prior art will be helpful in understanding the present invention. FIG. 1 is a side elevation in cross-section of a prior art pop-up drain assembly 10 in a sink or basin 12. The pop-up drain assembly 10 is received in the sink or basin 12, which is typical for a bathroom or a restroom. Sink 12 has a lower surface 12*a* that drains into a drain opening 12*b*. Sink 12 has an overflow port 12*c* in a side wall 12*d*. An outer wall 12*e* and side wall 12*d* define an overflow conduit or channel 12*f*, and side wall 12*d* has an overflow drain port 12*g* for draining overflow fluid into an overflow port in drain assembly 10. A faucet 14 is mounted on a top deck 12*h* of sink 12 for supplying water or other fluid to sink 12. Pop-up drain assembly 10 comprises a drain flange 16 that fits down through drain opening 12*b* in sink 12. Drain flange 16 has a threaded tubular portion extending essentially throughout its full length, and a flange 16*b* extends radially outwardly on a top end. Flange 16*b* is shown in FIG. 1 as formed integral with the tubular body of drain flange 16, but FIG. 2 in the present inventors' U.S. application Ser. No. 15/584,030 (Pub. No. 2017/0314244 A1) shows a more typical arrangement in which the flange portion is in threaded engagement with the tubular portion. FIG. 2 in the present inventors' U.S. application Ser. No. 15/584,030 shows a drain pipe that comprises a drain flange and a separate drain tube, which is in a threaded engagement with the drain flange. A gasket or plumber's putty 18 provides a seal between the lower surface 12*a* of the sink 12 and the flange 16*b* of drain flange 16. A flexible gasket 20 and a washer 20*a* are placed around a bottom portion of drain flange 16 and then pressed tightly against a bottom surface of sink 12 with a threaded nut 20*b*. A drain body 22 is threaded onto a lower end of drain flange 16. Drain body 22 has a wrench flange 22*a* for receiving a wrench for tightening and loosening drain body 22 with respect to drain flange 16. Drain body 22 has a pivot rod port 22*b*, and a threaded tubular stub 22*c* projects radially outwardly from drain body 22. A pivot rod seal 24 is received in stub 22*c*.

A pivot rod 26 has a stopper end 26*a* and an outer end 26*b*. A pivot ball 28 is sealingly received on pivot rod 26 closer to stopper end 26*a* than outer end 26*b*. Pivot rod 26 is received in stub 22*c* such that stopper end 26*a* is inside the drain body 22, and the stopper ball 28 rests against pivot rod seal 24. A pivot rod cap 30 is threaded onto stub 22*c* sufficiently tightly to seal pivot ball 28 against pivot rod seal 24, but loose enough to allow pivot ball 28 and pivot rod 26 to pivot. An extension rod 32 having a plurality of holes, which are not shown, is received on outer end 26*b* of pivot rod 26 and held in place by a clip 32*a*. Extension rod 32 is bent so as to have two parallel portions 32*b* and 32*c* that are perpendicular to the longitudinal axis of the extension rod 32, and each of the two parallel portions has a hole through which a control rod 34 is received. Control rod 34 passes through a faucet port 14*a* and a sink control rod port 12*h*. Control rod 34 has a knob 34*a* at an upper end, and control rod 34 is fastened to extension rod 32 by a set screw 32*d*.

A stopper 40 is received in drain flange 16 and drain body 22. Stopper 40 has an elongate shaft 40*a* running its length, which has a longitudinal axis through the center of stopper 40. A cap 40*b* is located on an upper end while the drain assembly 10 is installed and operational, and a pivot rod receiving member 40*c* is located on an opposing lower end. The pivot rod receiving member 40*c* defines an opening through which stopper end 26*a* of pivot rod 26 protrudes for engaging and moving stopper 40, and pivot rod receiving member 40*c* may be referred to as open member 40*c*. Four flanges or fins, referred to collectively as fins 40*d*, extend longitudinally along shaft 40*a* and project radially, and fins 40*d* lie in two perpendicular and intersecting planes. The fins provide structural support for the shaft and center the stopper in the drain pipe.

FIG. 2 is a cross-section of a side elevation of a pop-up drain assembly 50, which is similar to the pop-up drain assembly 10 of FIG. 1. Pop-up drain assembly 50 has overflow ports 50*a* and 50*b* for receiving overflow water from a sink such as sink 12 in FIG. 1. However, pop-up drain assembly 50 has been converted for use in a vessel sink, which does not have an overflow port or an overflow channel. A cylindrical sleeve 52 has been inserted in the drain assembly 50 to cover the overflow ports 50*a* and 50*b*. Sleeve 52 has an upper end 52*a* and a flange 52*b* that extends radially outwardly from the upper end 52*a*, which has a circumferential groove 52*c* for receiving an O-ring 52*d*. Sleeve 52 has a lower end 52*e* and a pivot-rod port 52*f* through which a pivot rod 54 extends and connects to a lower end of a stopper 56.

Pop-up drain assembly 50 can be packaged and sold with the cylindrical sleeve 52 as a kit. The kit allows the drain assembly 50 to be used in a sink that has an overflow port and overflow channel, in which case the sleeve 52 would not be needed, or in a vessel sink, which does not have an overflow port or an overflow channel, after inserting the sleeve 52 into the drain assembly 50 to cover the overflow ports 50*a* and 50*b* in the drain assembly 50. By including the sleeve 52 with the drain assembly 50, the drain assembly 50 can be used in a sink that has an overflow port and an overflow channel or in a vessel sink that does not have overflow capability. Consequently, a hardware wholesaler or retailer or a plumbing supply business (plumbing parts suppliers) does not need to stock and keep in inventory a drain assembly that does not have overflow ports. The upper surface of the drain flange and the cap on the stopper have a finish Finishes that plumbing parts suppliers typically carry in inventory include chrome, brushed nickel, satin nickel, brass, polished brass, black, stainless steel and bronze. That is eight different finishes. The kit in FIG. 2 allows the plumbing parts suppliers to eliminate eight drain assemblies from inventory, the drain assembly, which does not have overflow ports, in eight different finishes.

There are alternative embodiments of the drain assembly 50 and the sleeve 52. There are a number of different configurations for a pop-up drain assembly. The drain flange may be made integral with the drain body. The drain flange may have male threads with the drain body having female threads. The section of the drain body with the pivot rod port and stub may be a separate component as opposed to being made integral with a drain pipe that connects to the drain flange. The lower end of the drain body may have female threads, which receive a drain tailpiece. The upper end 52*a* of the sleeve 52 may not have the flange 52*b* or the O-ring 52*d*, and the lower end 52*e* of the sleeve 52 may rest on the tailpiece. The sleeve 52 may be designed and sized to fit snugly inside the drain assembly 50 so as to effectively eliminate the need for any seal between an outer surface of the sleeve 52 and an inner surface of the drain assembly 50. The sleeve 52 may have protrusions located to be received in the overflow ports 50*a* and 50*b*, thereby serving as a detent mechanism to hold the sleeve 52 in a desired location inside drain assembly 50. These are some of a number of means for holding a hollow, cylindrical sleeve, which has a port for receiving a pivot rod, within a drain assembly for covering overflow ports in the drain assembly, thereby allowing the drain assembly to be used with a vessel sink without water leaking from the drain assembly through its overflow ports.

Figure 3A:
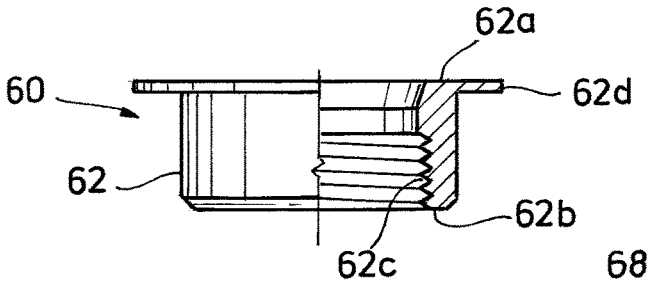
FIGS. 3A-3D are partial cross-sections of side elevations of a pop-up drain assembly kit that includes a drain flange, a lower tailpiece, a connector without an overflow port and a connector with overflow ports, according to the present invention.
Figure 3C:
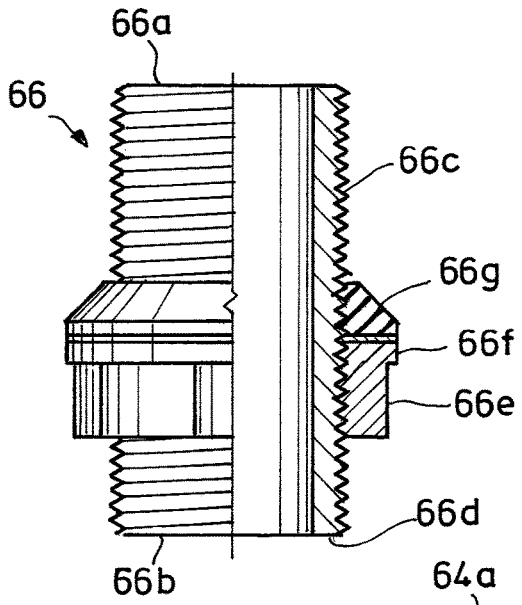
Figure 3D:
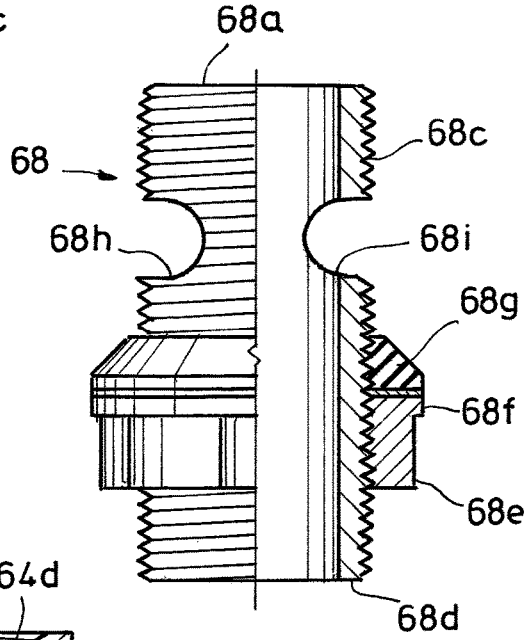
Figure 3B:
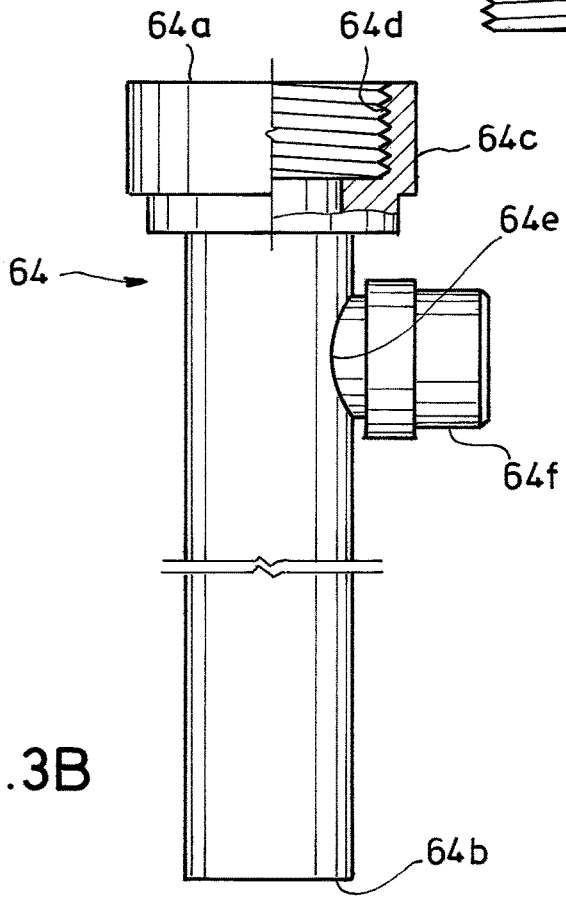

FIGS. 3A-3D are partial cross-sections of side elevations of a pop-up drain assembly kit 60 that includes a drain flange 62, a lower tailpiece 64, an extension 66 without an overflow port and a connector 68 with overflow ports. FIG. 3A is a side elevation in partial cross-section of the drain flange 62, which includes a short, hollow cylindrical pipe having an upper end 62*a*, a lower end 62*b*, female threads 62*c* proximal to the lower end 62*b* and a radially-outwardly-extending flange 62*d* on the upper end 62*a*. One alternative is to use male threads on the outside rather than the female threads 62*c* on the inside. Flange 62*d* could be a separate component, such as with a threaded connection to a different short, hollow cylindrical pipe. FIG. 3B is a side elevation in partial cross-section of the tailpiece 64. Tailpiece 64 comprises a section of pipe that has an upper end 64*a*, a lower end 64*b*, a thick and radially-outwardly-extending flange section 64*c* on and proximal to the upper end 64*a*, female threads 64*d* in the flange section 64*c* proximal to the upper end 64*a*, a pivot rod port 64*e* and a pivot rod stub 64*f* extending radially outwardly from the section of pipe and surrounding the pivot rod port 64*e*.

FIG. 3C is a side elevation in partial cross-section of the extension 66. Extension 66 is a short section of pipe having an upper end 66*a*, a lower end 66*b*, and male threads 66*c* on the outer surface of a sidewall 66*d*. A nut 66*e* having an integral washer section 66*f* is in threaded engagement with the threads 66*c*, and a gasket 66*g* is received between the nut 66*e* and the upper end 66*a*.

FIG. 3D is a side elevation in partial cross-section of the connector 68. Connector 68 is a short section of pipe having an upper end 68*a*, a lower end 68*b*, and male threads 68*c* on the outer surface of a sidewall 68*d*. A nut 68*e* having an integral washer section 68*f* is in threaded engagement with the threads 68*c*, and a gasket 68*g* is received between the nut 68*e* and the upper end 68*a*. The sidewall 68*d* has overflow ports 68*h* and 68*i*. The section of pipe for connector 68 and extension 66 have the same length.

The pop-up drain assembly kit 60 is packaged and sold with the drain flange 62, the lower tailpiece 64, the extension 66 and the connector 68. The pop-up drain assembly kit 60 can be used with a vessel sink, which does not have overflow capability. For the vessel sink, the drain flange 62 would be placed in a drain opening in the sink with a suitable gasket or plumber's putty; the upper end 66*a* of the extension 66 would be threaded into the threads 62*c* in the drain flange 62; and the upper end 64*a* of the tailpiece 64 would be threaded onto the lower end 66*b* of the extension 66. The extension 66 does not have a hole or a port in the sidewall 66*d* because extension 66 is intended for use with a vessel sink, which does not have an overflow port or an overflow channel or conduit. If the drain assembly 60 is used with a vessel sink, then the connector 68 is not needed.

If the drain assembly 60 is to be used with a sink that has an overflow port and an overflow channel or conduit, then connector 68 is used instead of extension 66. Connector 68 is connected to drain flange 62 and tailpiece 64 in the same manner as described above for the extension 66. The connector 68 is designed and sized for the overflow ports 68*h* and 68*i* to align with an overflow channel in a sink for receiving overflow water into the connector 68 from the overflow channel. If the drain assembly 60 is used with a sink that has an overflow port and an overflow channel or conduit, then the extension 66 is not needed. A plumbing parts supplier may need to stock sixteen (16) different drain assemblies in inventory; one set without overflow ports for vessel sinks in eight (8) different finishes; and one set with overflow ports in eight (8) different finishes. The kit in FIGS. 3A-3D allows a plumbing parts supplier to eliminate eight drain assemblies from inventory. Eight (8) kits according to FIGS. 3A-3D in eight different finishes can be stocked in inventory, which can be used for either a vessel sink with extension 66 or with a sink with overflow capability with connector 68.

FIGS. 4A-4C are partial cross-sections of side elevations of a pop-up drain assembly kit 70, which is similar to the pop-up drain assembly kit 60 of FIGS. 3A-3D, except the drain flange has been made integral with a piece of drain pipe that connects between the drain flange and the tailpiece. FIG. 4A is a side elevation in partial cross-section of a tailpiece 72. Tailpiece 72 comprises a section of pipe that has an upper end 72*a*, a lower end 72*b*, a thick and radially-outwardly-extending flange section 72*c* on and proximal to the upper end 72*a*, female threads 72*d* (not shown) in the flange section 72*c* proximal to the upper end 72*a*, a pivot rod port 72*e* and a pivot rod stub 72*f* extending radially outwardly from the section of pipe and surrounding the pivot rod port 72*e*.

FIG. 4B is a side elevation in partial cross-section of a vessel-sink drain flange assembly 74. The vessel-sink drain flange assembly 74 includes a short section of pipe having an upper end 74*a*, a lower end 74*b*, and male threads 74*c* on the outer surface of a sidewall 74*d*. A nut 74*e* having an integral washer section 74*f* is in threaded engagement with the threads 74*c*. A gasket 74*g* is received between the nut 74*e* and the upper end 74*a*, and a radially-extending flange 74*h* is on the upper end 74*a*, which is to be received in a bottom of a sink with the lower end 74*b* passing through a drain opening in the sink.

FIG. 4C is a side elevation in partial cross-section of an overflow-sink drain flange assembly 76. The overflow-sink drain flange assembly 76 includes a short section of pipe having an upper end 76*a*, a lower end 76*b*, and male threads 76*c* on the outer surface of a sidewall 76*d*. A nut 76*e* having an integral washer section 76*f* is in threaded engagement with the threads 76*c*. A gasket 76*g* is received between the nut 76*e* and the upper end 76*a*, and a radially-extending flange 76*h* is on the upper end 76*a*, which is to be received in a bottom of a sink with the lower end 76*b* passing through a drain opening in the sink. Overflow-sink drain flange assembly 76 has overflow ports 76*i* and 76*j* for receiving overflow water from an overflow channel in a sink that has an overflow port.

The pop-up drain assembly kit 70 is packaged and sold with the tailpiece 64, the vessel-sink drain flange assembly 74 and the overflow-sink drain flange assembly 76. The pop-up drain assembly kit 70 can be used with a vessel sink, which does not have overflow capability. The vessel-sink drain flange assembly 74 is configured for use with the vessel sink, and the overflow-sing drain flange assembly would not be used. The lower end 74*b* of the vessel-sink drain flange assembly 74 is passed through a drain opening in the vessel sink, and the upper end 72*a* of the tailpiece 72 is threaded onto the lower end 74*b* of the vessel-sink drain flange assembly 74. The vessel-sink drain flange assembly 74 does not have a hole or a port in the sidewall 74*d* because the assembly 74 is intended for use with a vessel sink, which does not have an overflow port or an overflow channel or conduit.

If the overflow-sink drain flange assembly 76 is to be used with a sink that has an overflow port and an overflow channel or conduit, then the vessel-sink drain flange assembly 74 is not needed. The lower end 76*b* of the overflow-sink drain flange assembly 76 is passed through a drain opening in an overflow-type sink, and the tailpiece 72 is connected to the drain flange assembly 76 in the same manner as described above for the drain flange assembly 74. The overflow-sink drain flange assembly 76 is designed and sized for the overflow ports 76*i* and 76*j* to align with an overflow channel in a sink for receiving overflow water into the drain flange assembly 76 from the overflow channel. As stated with reference to FIGS. 3A-3D, a plumbing parts supplier may need to stock sixteen (16) different drain assemblies in inventory; one set without overflow ports for vessel sinks in eight (8) different finishes; and one set with overflow ports in eight (8) different finishes. The kit in FIGS. 4A-4C allows a plumbing parts supplier to eliminate eight drain assemblies from inventory. Eight (8) kits according to FIGS. 4A-4C in eight different finishes can be stocked in inventory, which can be used for either a vessel sink with vessel-sink drain flange assembly 74 or with a sink with overflow capability with overflow-sink drain flange assembly 76. The conversion kits of FIGS. 3A-3D and 4A-4C have been illustrated for use in a pop-up drain assembly, but can also be used in a push-type drain assembly and in a grid drain assembly.

Figures 5, 5A:
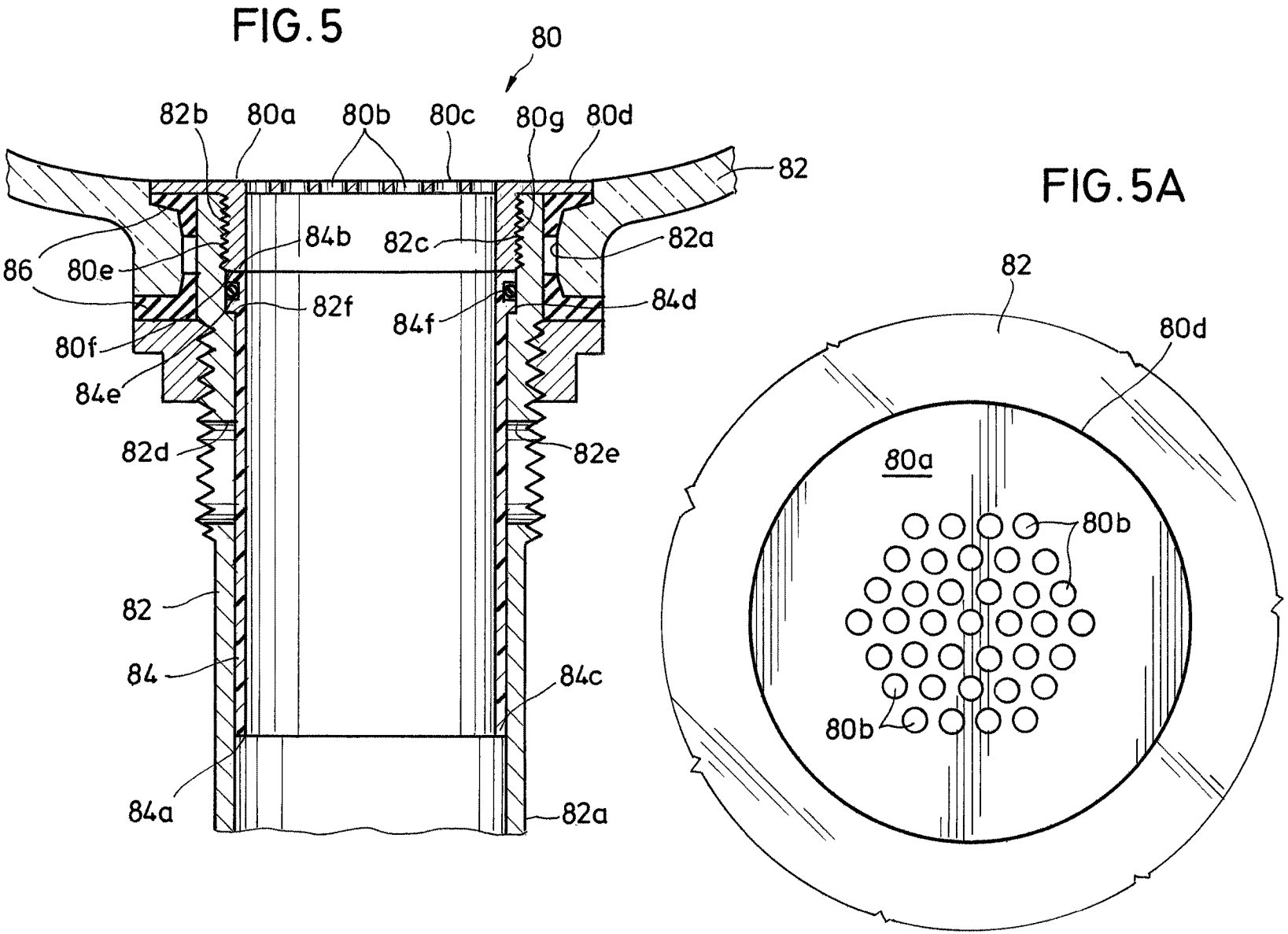
FIG. 5 is a cross-section of a side elevation of a grid drain assembly with overflow ports and an internal sleeve covering the overflow ports, according to the present invention.
FIG. 5A is a top plan view of the drain assembly of FIG. 5.

FIG. 5 is a cross-section of a side elevation of a grid drain assembly 80. FIG. 5A is a top plan view of the grid drain assembly 80 of FIG. 5. Grid drain assembly 80 is intended to always allow water to flow into the drain assembly and does not have a stopper or another closure mechanism. The grid drain assembly 80 is received in a vessel sink 82. Grid drain assembly 80 includes a drain flange 80*a*, a drain pipe 82 and a sleeve 84. Drain flange 80*a* has a plurality of drain holes 80*b* on an upper end 80*c*, a radially-extending flange 80*d* on the upper end 80*c*, a cylindrical section 80*e* extending downwardly from the upper end 80*c*, a lower end 80*f* and male threads 80*g* on an outer surface of the cylindrical section 80*e*. Drain pipe 82 is a cylindrical pipe that has a sidewall 82*a*, an upper end 82*b*, female threads 82*c* proximal to the upper end 82*b*, which engage the male threads 80*g*, overflow ports 82*d* and 82*e* and an internal shoulder 82*f*. Sleeve 84 is a hollow, cylindrical, thin-walled piece of pipe having a sidewall 84*a*, an upper end 84*b*, a lower end 84*c* and a radially-outwardly-extending flange 84*d*, which rests on the shoulder 82*f*. Flange 84*d* has a circumferential groove 84*e* in which an O-ring 84*f* is received. A gasket 86 provides a seal between a wall defining a drain opening 82*a* in sink 82 and drain flange 80*a* and drain pipe 82.

The grid drain assembly 80 is packaged and sold as a kit. The grid drain assembly 80 can be used in the vessel sink 82 as shown in and described with reference to FIG. 5. Gasket 86 and drain flange 80*a* are placed in the drain opening 82*a*. The O-ring 84*f* is placed in the groove 84*e*. The lower end 84*c* of the sleeve 84 is placed inside the drain pipe 82 and lowered until the flange 84*d* rests on the shoulder 82*f*. The male threads 80*g* on the drain flange 80*a* are threaded into the female threads 82*e* in the drain pipe 82. The sleeve 84 covers the overflow ports 82*d* and 82*e* in the drain pipe 82, thereby converting the grid drain assembly for use in the vessel sink 82. Alternatively, the grid drain assembly 80 is designed and sized to operate and function properly in a sink that has an overflow port and an overflow channel, and the sleeve 84 is not used. The overflow ports 82*d* and 82*e* align with the overflow channel in the overflow-type sink for receiving overflow water into the drain pipe 82. As stated above with reference to the previous kits, a plumbing parts supplier may need to stock sixteen (16) different grid drain assemblies 80 in inventory; one set without overflow ports for vessel sinks in eight (8) different finishes; and one set with overflow ports in eight (8) different finishes. The kit in FIG. 5 allows a plumbing parts supplier to eliminate eight drain assemblies from inventory. Eight (8) kits according to FIG. 5 in eight different finishes can be stocked in inventory, which can be used for either a vessel sink with sleeve 84 or with an overflow-type sink without using the sleeve 84.

Figure 6:
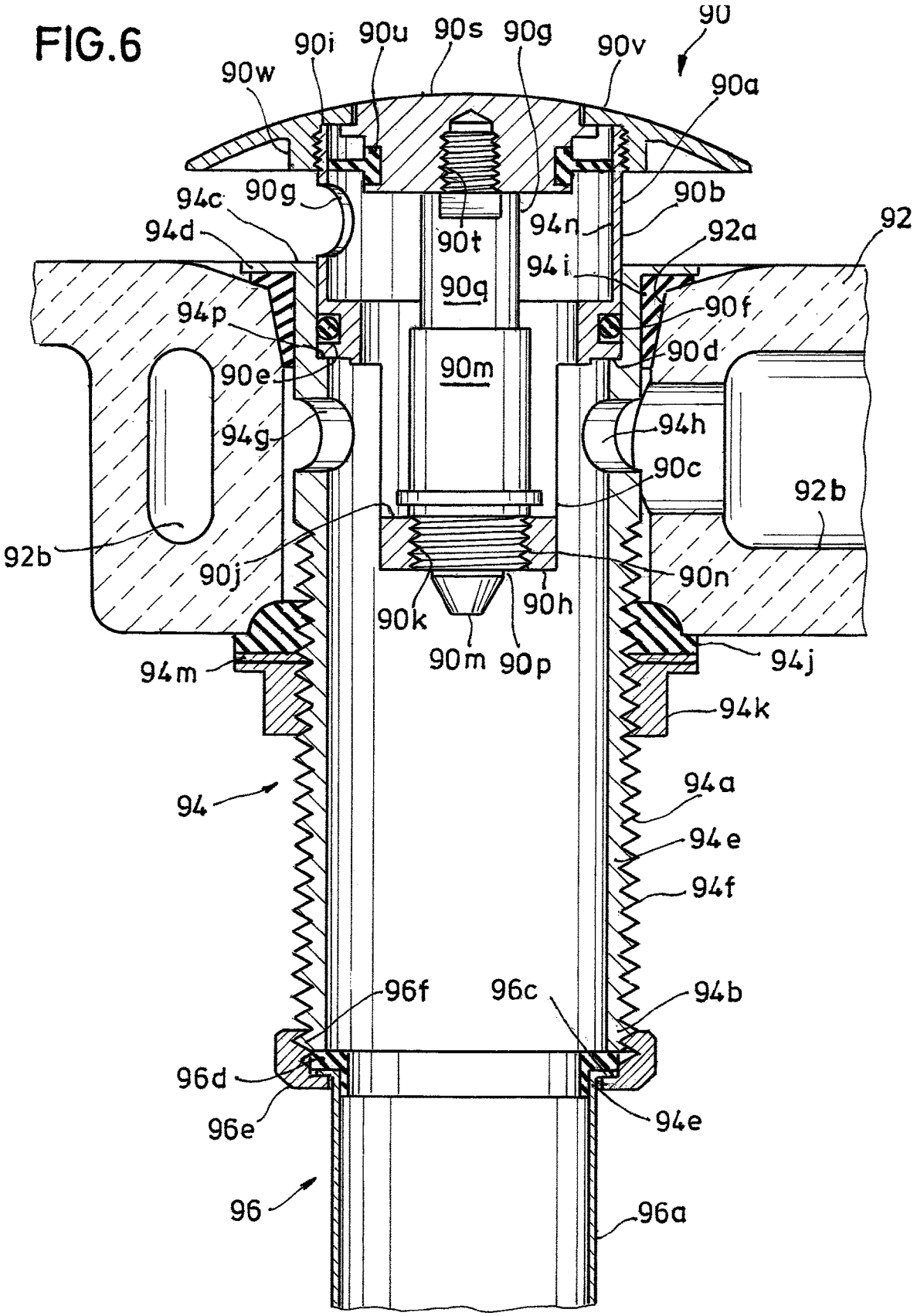
FIG. 6 is a cross-section of a side elevation of a push-button drain assembly with overflow ports in a sink with an overflow channel.

FIG. 6 is a cross-section of a side elevation of a push-button drain assembly 90 received in an overflow-type sink 92, which has a drain opening 92*a* and an overflow channel 92*b*. A drain flange assembly 94 is received in the drain opening 92*a* in the sink 92. Drain flange assembly 94 includes a cylindrical section of drain pipe 94*a*, which has a lower end 94*b* and an upper end 94*c* on which a radially-extending flange 94*d* is formed integral. Drain pipe 94*a* has a sidewall 94*e*, male threads 94*f* on an outer surface of the sidewall 94*e* and overflow ports 94*g* and 94*h*. A gasket 94*i* seals the flange 94*d* with the sink 92 in the drain opening 92*a*. A gasket 94*j* seals the drain pipe 94*a* with a lower surface of the sink 92, and a nut 94*k* with an integral washer 94*m* clamps the drain pipe 94*a* within the drain opening 92*a* in the sink 92. The overflow ports 94*g* and 94*h* are aligned with the overflow channel 92*b* in the sink 92. A tailpiece assembly 96 is received on the lower end 94*b* of the drain flange assembly 94. The tailpiece assembly 96 includes a cylindrical conduit 96*a*, which has an upper end 96*b* and an annular flange 96*c* that extends radially outwardly from the upper end 96*b*. A gasket 96*d* is received between the lower end 94*b* of the drain flange assembly 94 and the upper end 96*b* of the tailpiece assembly 96. A nut 96*e* having female threads 96*f* engages the annular flange 96*c* and screws onto the male threads 94*f* on the lower end of the drain flange assembly 94.

The push-button drain assembly 90 includes a cylindrical housing 90*a* having an upper portion 90*b* that has a greater diameter relative to a lower portion 90*c*, which has a lesser diameter. The transition between the upper portion 90*b* and the lower portion 90*c* defines a shoulder 90*d*, which faces downwardly. The sidewall 94*e* of the drain flange assembly 94 has an inside diameter 94*n* proximal to its upper end 94*c*, which abruptly decreases about 0.5 to 1.0 inch from the upper end 94*c*, thereby providing a shoulder 94*p*, which faces upwardly. The upper portion 90*b* of the housing 90*a* is received snugly in the inside diameter 94*n* of the drain flange assembly 94, and the push-button shoulder 90*d* abuts and rests on the drain-flange shoulder 94*p*. The upper portion 90*b* has a circumferential groove 90*e* above and proximal to the shoulder 90*d*. An O-ring 90*f* is received in the groove 90*e* and seals the upper portion 90*b* with the sidewall 94*e* in the inside diameter 94*n*. The upper portion 90*b* has a plurality of drain ports 90*g* for draining water from the sink 92.

The lower portion 90*c* of the housing 90*a* protrudes downwardly into the drain flange assembly 94 past the overflow ports 94*g* and 94*h*. The housing 90*a* has a lower end 90*h* and an upper end 90*i*. A nut 90*j* having a bore defined by female threads 90*k* is provided in the lower portion 90*c* adjacent to the lower end 90*h*. An elongate open-close mechanism 90*m* has male threads 90*n* on a lower end 90*p*, which are engaged with the female threads 90*k* in the nut 90*j*, thereby anchoring the open-close mechanism 90*m* in the housing 90*a*. The open-close mechanism 90*m* has an upper end 90*q*, and a stud 90*r* with male threads projects upwardly and outwardly from the upper end 90*q*. A push button 90*s* has a bore 90*t* defined by female threads, which are engaged with the male threads on the stud 90*r*, thereby attaching the push button 90*s* to the open-close mechanism 90*m*. A gasket 90*u* seals the push button 90*s* with an inside wall of the upper portion 90*b* of the housing 90*a*. An annular cap 90*v* has a central opening in which the push button 90*s* is received, and a short cylinder 90*w* having female threads on an inside wall extends downwardly from the underside of the annular cap 90*v*. The outer surface of the upper end 90*i* of the upper portion 90*b* of the housing 90*a* has male threads, which are engaged with the female threads in the cylinder 90*w*, thereby fastening the annular cap 90*v* to the upper portion 90*b* of the housing 90*a*. The open-close mechanism 90*m* in the push-button drain assembly 90 is a push-push mechanism in which one push moves the push button 90*s* into a closed position while a subsequent push moves the push button 90*s* back into an open position. The upper end 90*q* slides into the lower end 90*p* as the open-close mechanism 90*m* moves from open to closed. The upper end 90*q* slides out of the lower end 90*p* as the open-close mechanism 90*m* moves from its closed position back to its open position.

Figure 7A:
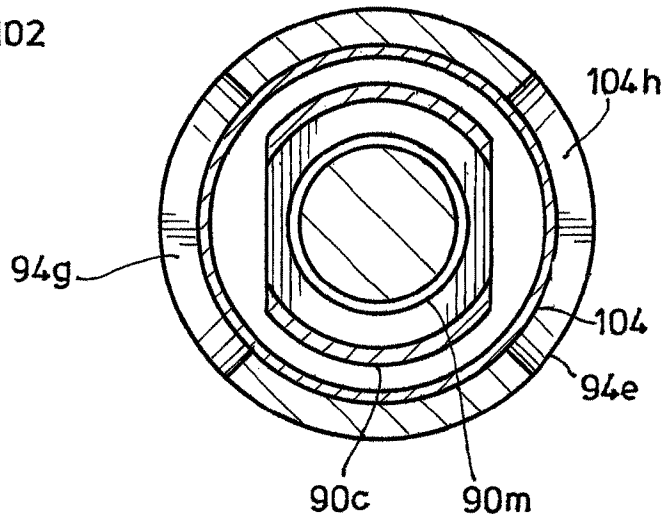
FIG. 7A is a cross-section of the drain assembly of FIG. 7, as seen along the line 7A-7A.
Figure 7:
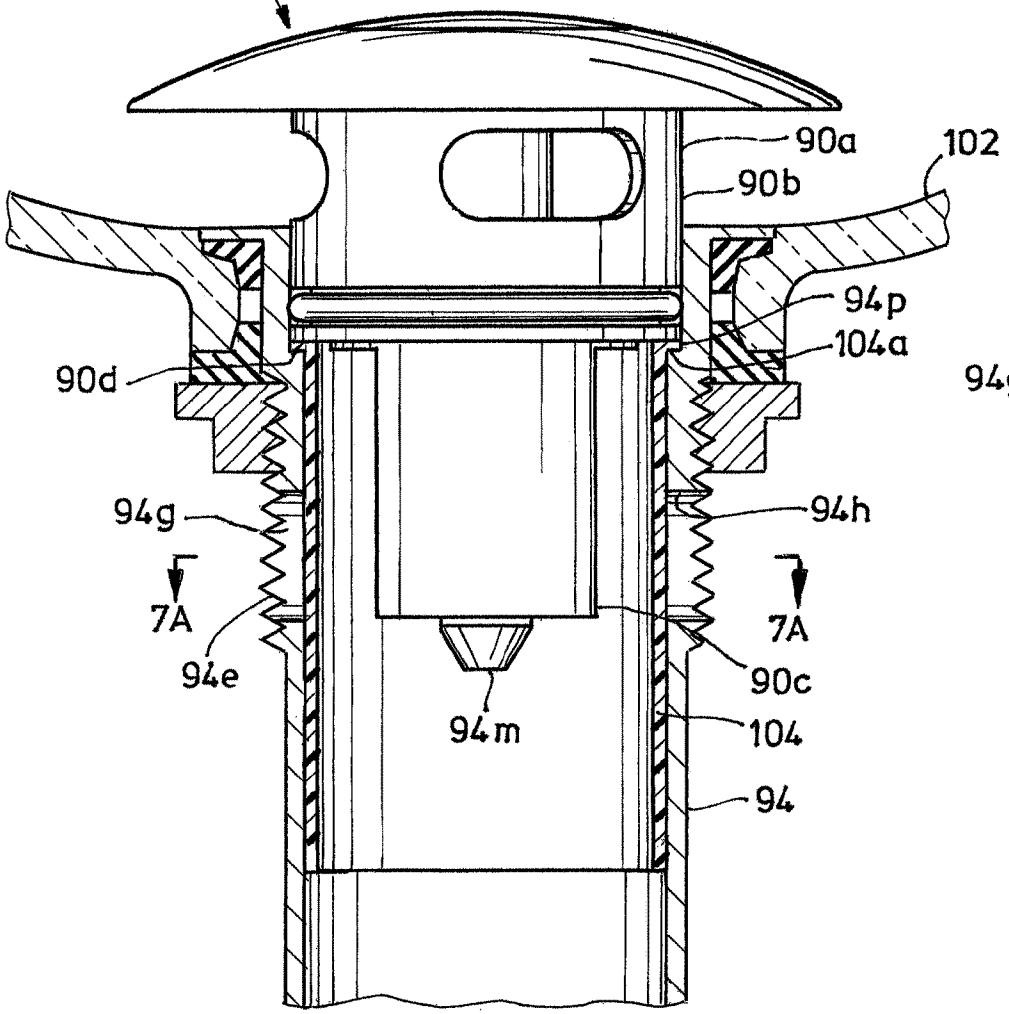
FIG. 7 is a cross-section of a side elevation of a push-button drain assembly with overflow ports and an internal sleeve covering the overflow ports, according to the present invention.

FIG. 7 is a cross-section of a side elevation of a drain system 100, which includes the push-button drain assembly 90 of FIG. 6 installed in a vessel sink 102. FIG. 7A is a cross-section of the drain assembly of FIG. 7, as seen along the line 7A-7A. The drain flange assembly 94 is installed in the vessel sink 102 as was described above with reference to FIGS. 5 and 6. The vessel sink 102 does not have an overflow channel and is consequently thinner than sink 92 in FIG. 6. The overflow ports 94*g* and 94*h* in drain flange assembly 94 would allow drain water from the vessel sink 102 to leak out of the drain flange assembly 94. A sleeve 104 is installed in the drain flange assembly 94 to cover the overflow ports 94*g* and 94*h* to prevent drain water from the sink 102 from leaking out through the overflow ports 94*g* and 94*h*. Sleeve 104 is a thin-walled, cylindrical tube or pipe, which has an outside diameter that is just slightly smaller than the inside diameter of the sidewall 94*e* in the drain flange assembly 94 so that the sleeve 104 fits snugly within, but can be slid easily into the drain flange assembly 94. Sleeve 104 has a small, radially outwardly extending annular flange 104*a* about its circumference on its upper end 104*b*. The flange 104*a* abuts and rests on the shoulder 94*p*, thereby holding the sleeve 104 in the drain flange assembly 94. The shoulder 90*d* on the push-button drain assembly 90 abuts and rests on the flange 104*a*, thereby trapping the flange 104*a* between the shoulder 90*d* on the push-button drain assembly 90 and the shoulder 94*p* on the drain flange assembly 94.

A kit can be packaged and sold that includes the drain flange assembly 94 and the sleeve 104. If the drain flange assembly 94 is used in an overflow-type sink as illustrated in FIG. 6, then the sleeve 104 is not needed. However, the drain flange assembly 94 can also be used in a vessel sink such as illustrated in FIG. 7 by inserting the sleeve 104 into the drain flange assembly 94 to cover the overflow ports 94*g* and 94*h*. The push-button drain assembly 90 is preferably included in the kit. A plumbing parts supplier can stock the kit in as many finishes as desired, but does not need to stock a drain flange assembly that does not have overflow ports, which is specific for vessel sinks. Consequently, the plumbing parts supplier can reduce inventory requirements by eliminating drain flange assemblies that do not have overflow ports from its inventory and instead stocking a kit that includes a drain flange assembly that has overflow ports with a sleeve to cover the overflow ports, preferably with a push-button drain assembly. In some push-drain assemblies, the entire cap pushes down rather than having an annular cap and a push button.

The kits described above have concerned using a drain flange assembly that has overflow ports with a vessel sink, which does not have an overflow channel. A sleeve is included in a kit with a drain flange assembly for covering and preventing water leakage out of the overflow ports when the drain flange assembly is used with a vessel sink. A drain stopper, such as a pop-up drain stopper or a push-push drain stopper, is preferably included in the kit. Another conversion is needed for some applications. The drain assemblies described above have a closed position for retaining water in a sink and an open position for draining water from the sink, except for the grid drain assembly 80 described with reference to FIG. 5. There are some applications, particularly commercial applications, where it is preferred that a drain assembly does not have a closed position for retaining water in a sink, where the drain assembly is always open. A drain assembly that has only an open position, without the capability of retaining water in a sink, is often referred to as an umbrella drain assembly. There are different ways to convert a drain assembly with an open-close mechanism, particularly a push-type open-close mechanism, to an umbrella drain assembly, which is always open.

Figure 9:
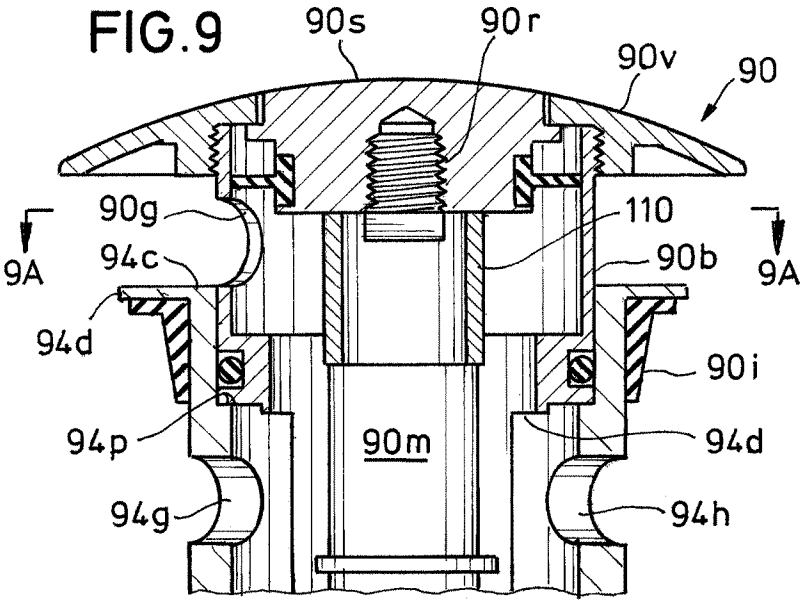
FIG. 9 is a cross-section of a side elevation of a push-button drain assembly with a cylindrical sleeve covering a portion of an open-close mechanism, which holds the drain assembly in an open position, according to the present invention.
Figure 9A:
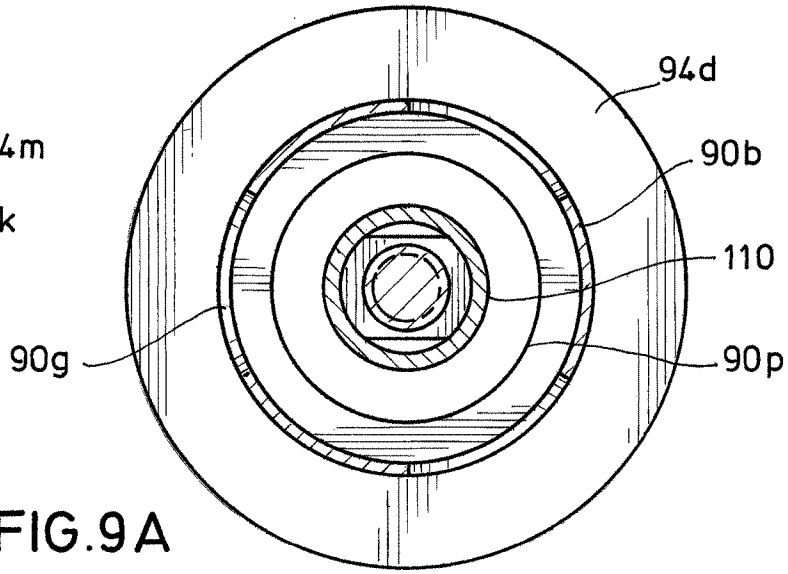
FIG. 9A is a cross-section of the drain assembly of FIG. 9, as seen along the line 9A-9A.
Figure 8:
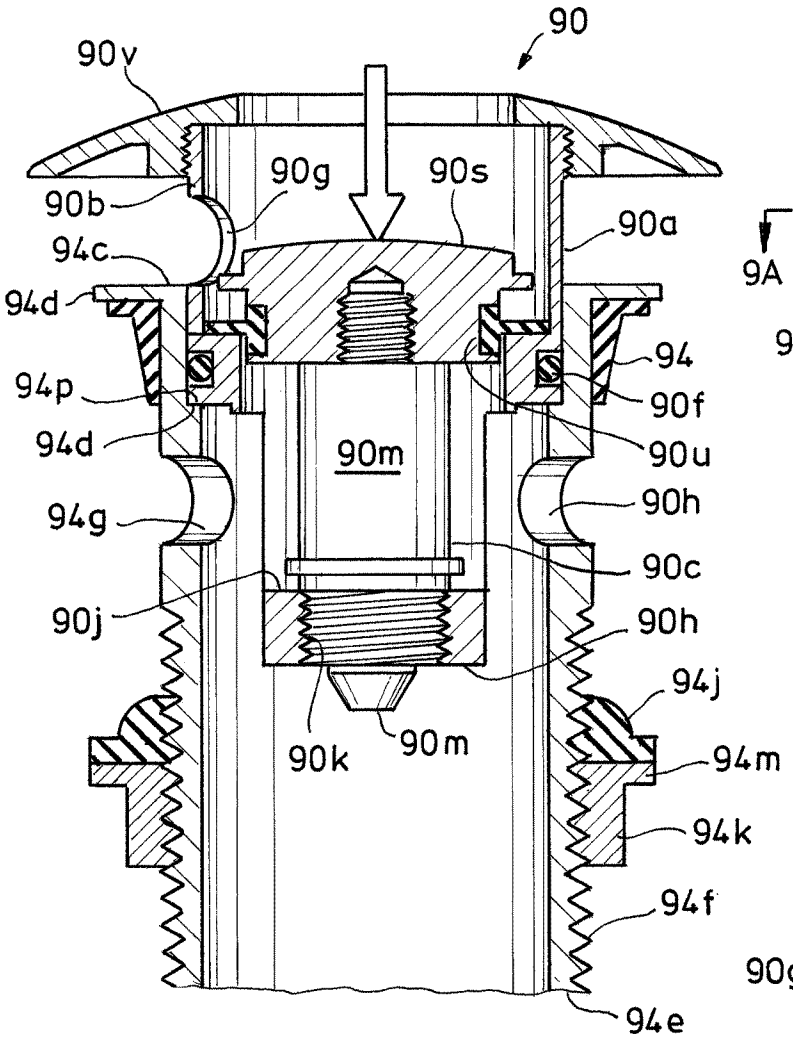
FIG. 8 is a cross-section of a side elevation of a push-button drain assembly with overflow ports in a closed position.

FIG. 8 is a cross-section of a side elevation of the push-button drain assembly 90 and drain flange assembly 94 of FIG. 6 in a closed position. The upper end 90*q* is inside the lower end 90*p* in the open-close mechanism 90*m* while in the closed position shown in FIG. 8. FIG. 9 is a cross-section of a side elevation of the push-button drain assembly 90 with a short, cylindrical sleeve 110 surrounding the upper end 90*q* of the open-close mechanism 90*m*, which holds the drain assembly 90 in an always-open position. FIG. 9A is a cross-section of the drain assembly of FIG. 9, as seen along the line 9A-9A. The sleeve 110 is installed by unscrewing the push button 90*s* from the stud 90*r* and placing the sleeve 110 around and down on the upper end 90*q* of the open-close mechanism 90*m* and then screwing the push button 90*s* back onto the stud 90*r*. A kit that includes sleeve 110, push-button drain assembly 90 and drain flange assembly 94 allows one to install a drain assembly with open and closed positions or a drain assembly that is only always open. The kit preferably also includes the sleeve 104 of FIG. 7A for covering the overflow ports 94*g* and 94*h* in the sidewall 94*e* of the drain flange assembly 94. A plumbing parts supplier can stock a kit with the drain flange assembly 94 and the push-button drain assembly 90, which can be used in an overflow-type sink with open-and-closed functionality, with the sleeve 104 (of FIG. 7) to cover overflow ports for use in a vessel sink and with sleeve 110 to lock the open-close mechanism into an open-only position.

Figure 10:
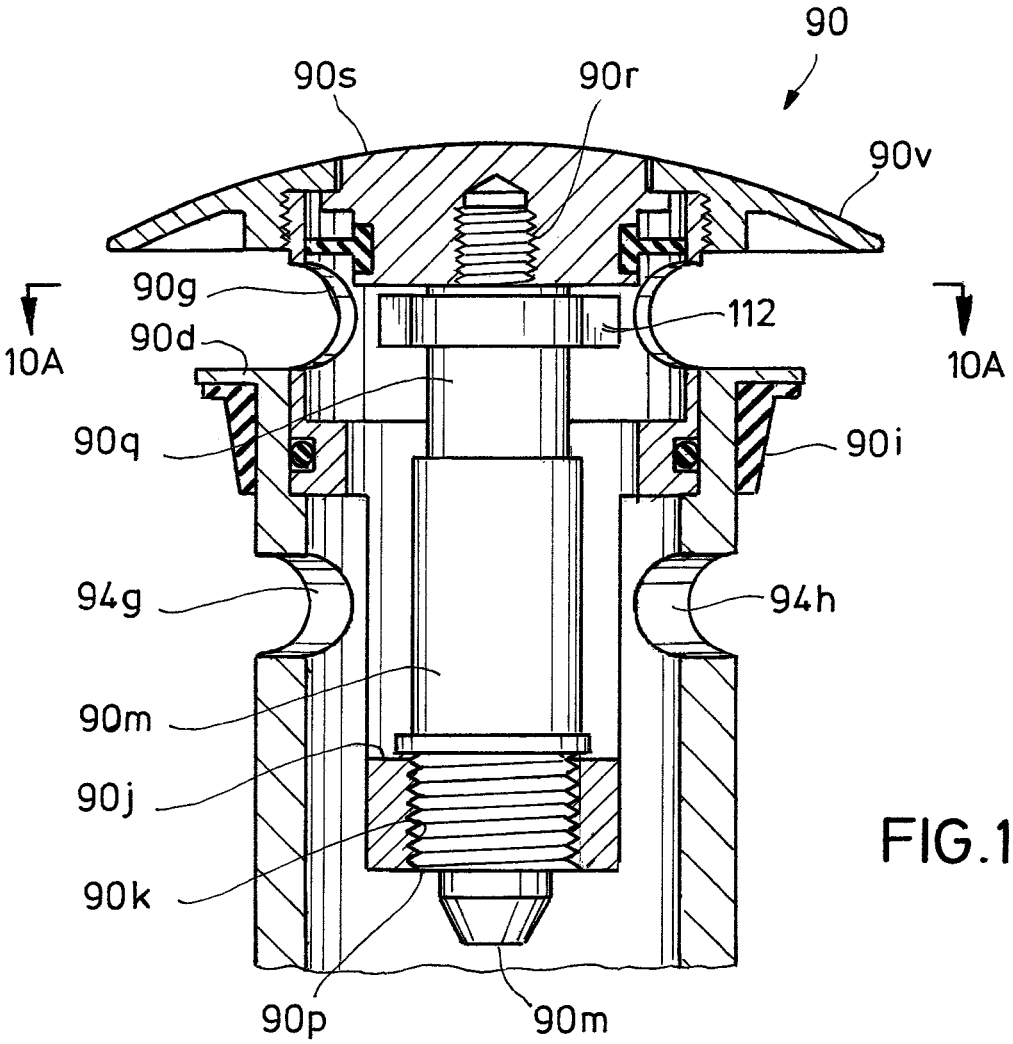
FIG. 10 is a cross-section of a side elevation of a push-button drain assembly with a C-clip covering a portion of an open-close mechanism, which prevents the drain assembly from moving into a closed position, according to the present invention.
Figure 10A:
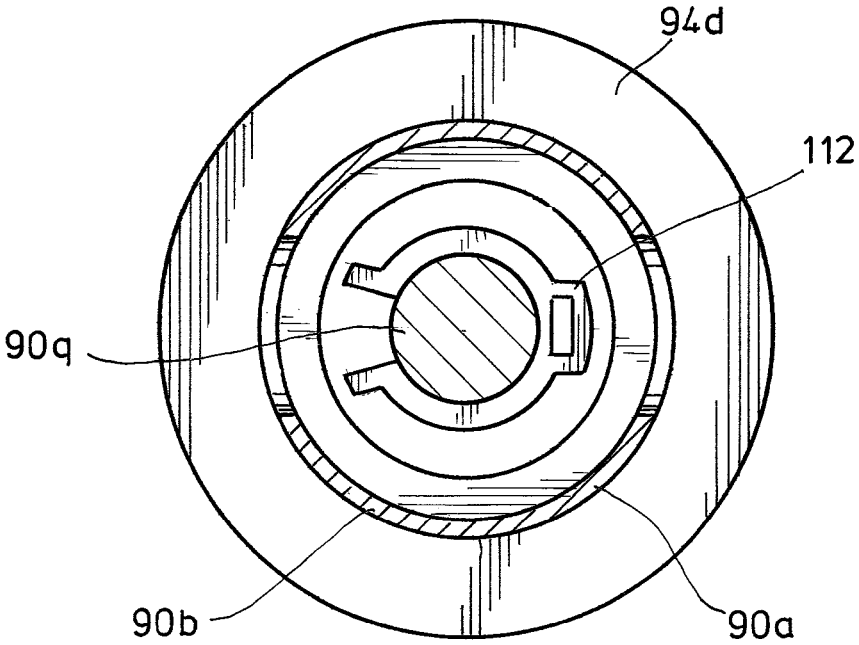
FIG. 10A is a cross-section of the drain assembly of FIG. 10, as seen along the line 10A-10A.

FIG. 10 is a cross-section of a side elevation of the push-button drain assembly 90 and the drain flange assembly 94 in which another method for preventing the push-button drain assembly 90 from being in a closed position is disclosed. FIG. 10A is a cross-section of the drain assembly of FIG. 10, as seen along the line 10A-10A. The push-button drain assembly 90 and the drain flange assembly 94 were described above with reference to FIG. 6. A C-clip 112 has been placed around the upper end 90*q* of the open-close mechanism 90*m*, which prevents the drain assembly 90 from entering into its closed position, thereby effectively placing the open-close mechanism 90*m* in an always-open position. The C-clip 112 is installed by unscrewing the push button 90*s* from the stud 90*r* and placing the C-clip 112 around the upper end 90*q* of the open-close mechanism 90*m* while it is in its open position and then screwing the push button 90*s* back onto the stud 90*r*. The push button 90*s* can move downwardly to some extent, but not enough to move from its open position to its closed position. A plumbing parts supplier can stock a kit with the drain flange assembly 94 and the push-button drain assembly 90, which can be used in an overflow-type sink with open-and-closed functionality, with the sleeve 104 (of FIG. 7) to cover overflow ports for use in a vessel sink and with the C-clip 112, which prevents the open-close mechanism from moving into its closed position.

Figure 11:
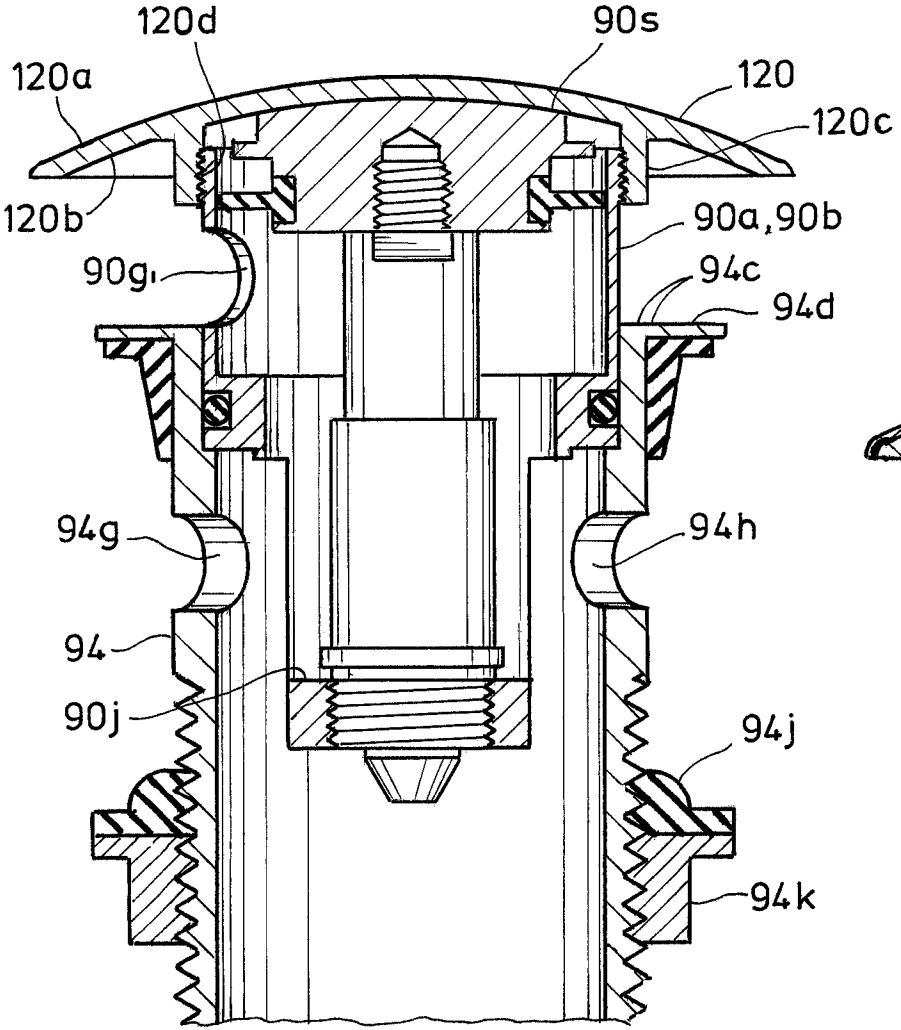
FIG. 11 is a cross-section of a side elevation of a push-button drain assembly with a solid cap replacing an annular cap, which prevents the drain assembly from being moved into a closed position, according to the present invention.

FIG. 11 is a cross-section of a side elevation of the push-button drain assembly 90 and the drain flange assembly 94 in which another method for preventing the push-button drain assembly 90 from being in a closed position is disclosed. The annular cap 90*v* in FIG. 6 has been removed and replaced by a solid cap 120 in FIG. 11. The push-button 90*s* is still there, but it is inaccessible because the solid cap 120 does not have an opening as in the annular cap 90*v* in FIG. 6 for providing access to push the push-button 90*s*. As was stated with reference to FIG. 6, the annular cap 90*v* is fastened to the upper portion 90*b* of the housing 90*a* via a threaded engagement in which the outer surface of the upper end 90*i* of the upper portion 90*b* of the housing 90*a* has male threads, which are engaged with female threads in the cylinder 90*w* , which is a lower portion of the annular cap 90*v*. Similarly, the solid cap 120 has a dome-shaped upper portion 120*a*, which has an underside 120*b*, and a short, cylindrical portion 120*c* extends downwardly from the underside 120*b* and has female threads 120*d* on an inside surface. One installs the solid cap 120 by unscrewing the annular cap 90*v*; pushing the push-button 90*s* so as to place the open-close mechanism 90*m* in an open position; and screwing the solid cap 120 onto the upper end 90*i* of the of the housing 90*a*, thereby engaging the female threads 129*d* with the male threads on the upper end 90*i* of the of the housing 90*a*.

The solid cap 120 covers the push-button 90*s*, which prevents the open-close mechanism 90*m* from being moved into a closed position. A plumbing parts supplier can stock a kit with the drain flange assembly 94 and the push-button drain assembly 90, which can be used in an overflow-type sink with open-and-closed functionality, with the sleeve 104 (of FIG. 7) to cover overflow ports for use in a vessel sink and with the solid cap 120, which prevents the open-close mechanism from moving into its closed position. Another kit that can be packaged and sold includes a modified drain flange assembly replacing the assembly 94 with an assembly that has female threads in an upper end as shown for the grid drain assembly 80 in FIG. 5 and a grid drain flange such as the drain flange 80*a* in FIG. 5. One can then remove the housing 90*a* and the open-close mechanism 90*m* and screw in the grid drain flange.

Figure 12:
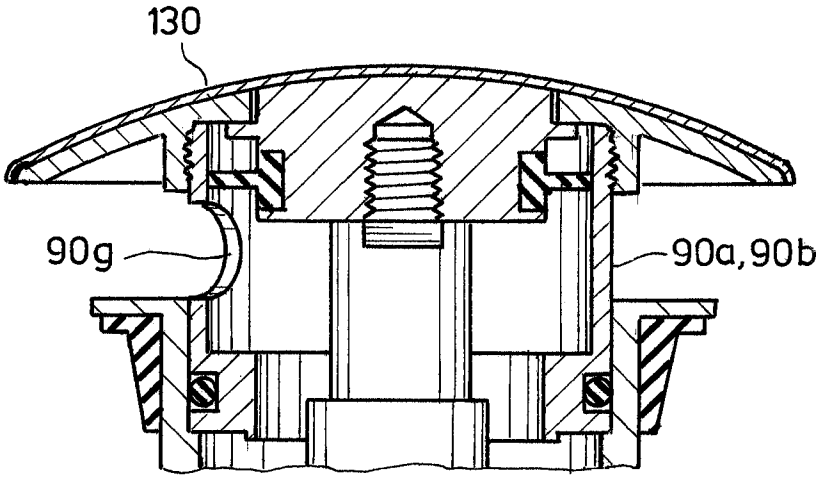
FIG. 12 is a cross-section of a side elevation of a push-button drain assembly with a thin cap cover covering an annular cap, which prevents the drain assembly from being moved into a closed position, according to the present invention.

FIG. 12 is a cross-section of a side elevation of the push-button drain assembly 90 and the drain flange assembly 94 in which another method for preventing the push-button drain assembly 90 from being in a closed position is disclosed. All of the components for the push-button drain assembly 90 and the drain flange assembly 94 described with reference to FIG. 6 are included in FIG. 12. To convert the push-button drain assembly 90 from having open and closed positions to having only an open position, one first ensures the push-button drain assembly 90 is in its open position and then snaps a thin cap cover 130 onto the upper surface of the annular cap 90*v*. Cap cover 130 has a dome-shaped upper portion 130*a* and a downwardly-extending sidewall 130*b*. Cap cover 130 is designed and sized for the upper portion 130*a* to perfectly cover the annular cap 90*v* and the push-button 90*s* and for the sidewall 130*b* to engage the outer perimeter of the annular cap 90*v* in a snap fit. As the cap cover 130 is pressed onto the annular cap 90*v*, the cap cover 130, particularly its sidewall, expands or stretches slightly to pass over a greatest diameter of the perimeter of the annular cap 90*v* and then contracts or shrinks back to its normal size, thereby engaging the annular cap 90*v* in a snap-fir or a press-fit.

After installation of the cap cover 130, one no longer has access to the push button 90*s*, and so, one cannot push the push button 90*s* to change the change the open-close mechanism 90*m* from open to closed. A plumbing parts supplier can stock a kit with the drain flange assembly 94 and the push-button drain assembly 90, which can be used in an overflow-type sink with open-and-closed functionality, with the sleeve 104 (of FIG. 7) to cover overflow ports for use in a vessel sink and with the cap cover 130, which prevents the open-close mechanism 90*m* from being moved into its closed position because the cap cover 130 covers and hides the push-button 90*s*.

The present invention concerns a kit or various kits that can be packaged and sold that include a drain assembly and various components, which do not include a drain flange assembly made without overflow ports specifically for use in a vessel sink or a drain flange assembly made specifically for always remaining in an open position, except for the grid drain assembly 80 in FIG. 5. A kit according to the present invention allows one to install a satisfactory drain assembly in a number of different applications, including the following. A kit may include components for a drain flange assembly and a drain assembly that includes an open-close mechanism, which can be installed and operable in an overflow-type sink for retaining water in and draining water from the sink. A kit may include components for a drain flange assembly and a drain assembly that includes an open-close mechanism, which can be installed and operable in a vessel sink for retaining water in and draining water from the sink, where the vessel sink does not have an overflow port or an overflow channel. The open-close mechanism may be a pop-up drain operable through a control rod connected to a pivot rod as disclosed in FIGS. 2, 3A-3D and 4A-4C with a means for blocking or covering or not providing overflow ports in the drain flange assembly including the means described with reference to the sleeve 52 in FIG. 2, the extension 66 in FIG. 3C and the vessel sink drain flange 74 in FIG. 4B. A kit may include a grid drain assembly such as described with reference to FIG. 5, which can be used in an overflow-type sink, and which can be used in a vessel sink by including the sleeve 84 in the kit to cover the overflow ports 82*d* and 82*e* in the drain pipe 82. A kit may include the push-button drain assembly 90 and the drain flange assembly 94 described with reference to FIG. 6, which can be installed and operable in an overflow-type sink for retaining water in and draining water from the sink. The kit may include the sleeve 104 described with reference to FIG. 7 so that the push-button drain assembly 90 and the drain flange assembly 94 described with reference to FIG. 6 can be used in a vessel sink, which does not have an overflow port or overflow channel, because the sleeve 104 covers the overflow ports 94*g* and 94*h* in the drain flange assembly 94.

The drain assembly described with reference to FIG. 6 employs the push-button drain assembly 90. Alternatively, some push-type drain assemblies have the entire cap push down rather than having a button in the middle of an annular cap. The present inventors' U.S. Pat. No. 10,301,803, issued May 28, 2019, describes a push-type drain assembly in which the entire cap is pushed down. Both types of push drains can be converted to open-only drains with a kit according to the present invention. One kit includes a push-button drain assembly 90, a drain flange assembly 94 (FIG. 6) and means for preventing the open-close mechanism from moving from its open position to its closed position. One means for preventing the open-close mechanism from moving from its open position to its closed position is the sleeve 110 described with reference to FIG. 9 and another means is the C-clip 112 described with reference to FIG. 10. The sleeve 110 and the C-clip 112 can be used with a drain assembly in which the entire cap pushes down as opposed to having a push-button, so a kit can include either type of push drain assembly. Another kit includes a push-button drain assembly 90, a drain flange assembly 94 (FIG. 6) and means for covering the push-button 90*s* of FIG. 6, thereby allowing one to install the push-button drain assembly 90 and the drain flange assembly 94 of FIG. 6, but to deny access to the push-button 90*s*, thereby leaving the drain assembly 90 in its open position at all times. One means for covering the push-button 90*s* of FIG. 6 is the solid cap 120 described with reference to FIG. 11 and another means is the thin cap cover 130 described with reference to FIG. 12. Kits that contain means for converting drain assemblies that have open and closed positions to always be open can include a sleeve for covering overflow ports in the drain flange assembly so that one drain assembly can be used in either an overflow-type sink or in a vessel sink without overflow capability.

As is apparent from the description above, a number of different kits can be packaged and sold, which reduce inventory requirements for a plumbing parts supplier. A first kit includes a push-button drain assembly, which either has or does not have overflow ports. The kit may include one or more of a sleeve to cover a portion of an open-close mechanism (FIG. 9), C-clip (FIG. 10), a solid cap to replace an annular cap (FIG. 11) and/or a cap cover (FIG. 12). A second kit includes one of a push-button drain assembly, a grid drain assembly or a pop-up drain assembly, each of which has overflow ports. The second kit also includes a sleeve (see FIGS. 2, 5 and 7) or a selection of a drain pipe with or without overflow ports (see FIGS. 3A-3D and 4A-4C), which can be used to convert or adapt the drain assembly that has overflow ports to function properly in a vessel sink, which does not have an overflow port, overflow channel or overflow conduit. The sleeve is placed inside the drain assembly, where it covers and seals off the overflow ports in the drain assembly. The sleeve is preferably sealed with the drain assembly at its upper and lower ends. There are a number of additional kits that a plumbing parts supplier can sell. One kit includes a push-button drain assembly, a sleeve to surround an open-close mechanism or a C-clip and/or a solid cap and/or a cap cover and a sleeve for placement inside the drain assembly to seal off overflow ports. Another kit includes a grid drain assembly and a sleeve for placement inside the drain assembly to seal off overflow ports. Another kit includes a pop-up drain assembly and a sleeve for placement inside the drain assembly to seal off overflow ports.

The kits described above provide a plumbing parts supplier a method for reducing its inventory requirement for sink drain assembly components, which comprises the steps of selling a kit with a push-type drain assembly with or without overflow ports and means for converting the drain assembly to an umbrella drain assembly and eliminating umbrella drain assemblies from inventory. A second method comprises the steps of selling a kit with a drain assembly (pop-up, push-type or grid) that has overflow ports and a sleeve for covering the overflow ports and eliminating from inventory pop-up, push-type and grid drain assemblies for vessel sinks that do not have overflow ports. A third method comprises the steps of selling a kit with a push-type drain assembly that has overflow ports and means for converting the drain assembly to an always-open umbrella drain assembly and a sleeve for covering the overflow ports and eliminating from inventory umbrella drain assemblies and drain assemblies for vessel sinks, which do not have overflow ports. A fourth method comprises the steps of selling a kit with a grid drain assembly that has overflow ports and a sleeve for covering the overflow ports and eliminating from inventory grid drain assemblies for vessel sinks, which do not have overflow ports. A fifth method comprises the steps of selling a kit with a pop-up drain assembly that has overflow ports and a sleeve for covering the overflow ports and eliminating from inventory pop-up drain assemblies for vessel sinks, which do not have overflow ports.

The disclosure above generally describes a method for a plumbing parts supplier to reduce inventory and increase profitability, which comprises the steps of selling a kit that includes a drain assembly for a first application and means for converting the drain assembly to operate satisfactorily in a second application and eliminating from inventory drain assemblies made specifically for the second application.

Embodiments of the Invention

1. A kit containing parts for plumbing a sink to drain water from the sink through a drain opening, the kit comprising: a drain assembly that includes a drain flange for placement in the sink around the drain opening and a drain pipe that connects directly or indirectly to the drain flange, wherein the drain assembly is designed and configured for use in a first application; and means for converting the drain assembly for use in a second application.

2. The kit of embodiment 1, wherein the drain pipe has an overflow port and a pivot rod port, further comprising a pop-up drain stopper, wherein the means for converting the drain assembly for use in a second application is a sleeve that fits in the drain pipe and covers the overflow port and has a hole configured to align with the pivot rod port.

3. The kit of embodiment 1, wherein the drain assembly is designed and configured for use in an overflow-type sink; and wherein the means for converting the drain assembly for use in a second application is a section of pipe designed and configured to extend between the drain flange and the drain pipe, and wherein the section of pipe has a sidewall that does not have an opening for receiving water from an overflow channel through the sidewall, thereby converting the drain assembly for use in a vessel sink.

4. The kit of embodiment 1, wherein the drain assembly is a grid drain assembly designed and configured for use in an overflow-type sink, wherein the drain pipe has an overflow port, and wherein the means for converting the drain assembly for use in a second application is a sleeve that fits in the drain pipe and covers the overflow port, thereby converting the drain assembly for use in a vessel sink.

5. The kit of embodiment 1, wherein the drain assembly is a push-type drain assembly designed and configured for use in an overflow-type sink.

6. The kit of embodiment 5, wherein the drain pipe has an overflow port, wherein the means for converting the drain assembly for use in a second application is a sleeve that fits in the drain pipe and covers the overflow port, thereby converting the drain assembly for use in a vessel sink.

7. The kit of embodiment 5, wherein the drain assembly includes a push-type open-close mechanism, and wherein the means for converting the drain assembly for use in a second application is a sleeve that surrounds the open-close mechanism and prevents the open-close mechanism from being moved into a closed position, thereby converting the push-type drain assembly into an umbrella drain assembly.

8. The kit of embodiment 5, wherein the drain assembly includes a push-type open-close mechanism, and wherein the means for converting the drain assembly for use in a second application is a C-clip configured to fit on a portion of the open-close mechanism and to prevent the open-close mechanism from being moved into a closed position, thereby converting the push-type drain assembly into an umbrella drain assembly.

9. The kit of embodiment 5, wherein the push-type drain assembly has a push button and an annular cap that surrounds the push button, and wherein the means for converting the drain assembly for use in a second application is a solid cap that replaces the annular cap, thereby preventing a person from being able to push the push button for moving the drain assembly from an open position to a closed position, and thereby converting the push-type drain assembly to an umbrella drain assembly.

10. The kit of embodiment 5, wherein the push-type drain assembly has a push button and an annular cap that surrounds the push button, and wherein the means for converting the drain assembly for use in a second application is a cap cover that covers the push button and the annular cap, thereby preventing a person from being able to push the push button for moving the drain assembly from an open position to a closed position, and thereby converting the push-type drain assembly to an umbrella drain assembly.

11. The kit of embodiment 7, 8, 9 or 10, wherein the drain pipe has an overflow port, further comprising a sleeve that fits in the drain pipe and covers the overflow port, thereby converting the drain assembly for use in a vessel sink.

Having described the invention above, various modifications of the techniques, procedures, materials, and equipment will be apparent to those skilled in the art. It is intended that all such variations within the scope and spirit of the invention be included within the scope of the appended claims.

What is claimed is:

1. A method for a plumbing parts supplier to reduce inventory and increase profitability comprising the steps of:

selling a kit that includes a sink drain assembly for a first application and means for converting the drain assembly to operate in a second application; and eliminating from inventory a second drain assembly made specifically for the second application, wherein the means for converting the drain assembly is a selection between first and second drain pipes, wherein the first drain pipe has an overflow port and the second drain pipe does not have an overflow port, wherein the kit includes a single drain flange and the first and second drain pipes, and wherein either of the first and second drain pipes can be used with the drain flange.

2. The method of claim 1, the kit includes a tailpiece that can be connected to either of the first and second drainpipes such the first or the second drain pipe is located between the drain flange and the tailpiece.

3. The method of claim 1, wherein the sink drain assembly is selected from the group consisting of: a pop-up drain assembly, a push-type drain assembly and a grid drain assembly.

4. A method for a plumbing parts supplier to reduce inventory and increase profitability comprising the steps of:

selling a kit that includes a sink drain assembly for a first application and means for converting the drain assembly to operate in a second application; and eliminating from inventory a second drain assembly made specifically for the second application, wherein the sink drain assembly for the first application is a pop-up drain assembly that has overflow ports and a pivot rod for moving a drain stopper between open and closed positions, wherein the means for converting the drain assembly is a sleeve that fits inside the drain assembly and covers the overflow ports so that the sink drain assembly can be used in a sink that does not have an overflow channel, and wherein the sleeve has a pivot rod port through which the pivot rod can pass.

5. A method for a plumbing parts supplier to reduce inventory and increase profitability comprising the steps of:

selling a kit that includes a sink drain assembly for a first application and means for converting the drain assembly to operate in a second application; and eliminating from inventory a second drain assembly made specifically for the second application, wherein the sink drain assembly for the first application is a push-type drain assembly, wherein the second application is an umbrella drain assembly, wherein the means for converting the drain assembly is a cylindrical sleeve that fits around and surrounds a portion of an open-close mechanism and prevents the open-close mechanism from moving from an open position to a closed position.

6. The method of claim 5, wherein the push-type drain assembly is a push-button drain assembly.

7. The method of claim 5, wherein the kit further comprises a second sleeve that fits inside the drain assembly for covering an overflow port.

8. A method for a plumbing parts supplier to reduce inventory and increase profitability comprising the steps of:

selling a kit that includes a sink drain assembly for a first application and means for converting the drain assembly to operate in a second application; and eliminating from inventory a second drain assembly made specifically for the second application, wherein the sink drain assembly for the first application is a push-type drain assembly, wherein the second application is an umbrella drain assembly, wherein the means for converting the drain assembly is a C-clip that fits around a portion of an open-close mechanism and prevents the open-close mechanism from moving from an open position to a closed position.

9. The method of claim 8, wherein the kit further comprises a sleeve that fits inside the drain assembly for covering an overflow port.

10. A method for a plumbing parts supplier to reduce inventory and increase profitability comprising the steps of:

selling a kit that includes a sink drain assembly for a first application and means for converting the drain assembly to operate in a second application; and eliminating from inventory a second drain assembly made specifically for the second application, wherein the sink drain assembly for the first application is a push-button drain assembly, wherein the second application is an umbrella drain assembly, wherein the push-button drain assembly has a push button surrounded by an annular cap, wherein the means for converting the drain assembly is a solid cap that replaces the annular cap and covers the push button, thereby preventing a person from pushing the push button to place the push-button drain assembly in a closed position.

11. The method of claim 10, wherein the kit further comprises a sleeve that fits inside the drain assembly for covering an overflow port.

12. A method for a plumbing parts supplier to reduce inventory and increase profitability comprising the steps of:

selling a kit that includes a sink drain assembly for a first application and means for converting the drain assembly to operate in a second application; and eliminating from inventory a second drain assembly made specifically for the second application, wherein the sink drain assembly for the first application is a push-type drain assembly, wherein the second application is an umbrella drain assembly, wherein the push-type drain assembly is a push-button drain assembly that has a push button surrounded by an annular cap, wherein the means for converting the drain assembly is a cap cover that covers the annular cap and the push button, and wherein the cap cover prevents a person from pushing the push button to place the push-button drain assembly in a closed position.

13. The method of claim 12, wherein the kit further comprises a sleeve that fits inside the drain assembly for covering an overflow port.

14. A kit containing parts for plumbing a sink to drain water from the sink through a drain opening, the kit comprising:

a drain assembly that includes a drain flange for placement in the sink around the drain opening and a first drain pipe that is formed integral with or that connects directly or indirectly to the drain flange, wherein the drain assembly is designed and configured for use in a first application in which a sink has an overflow channel, wherein the first drain pipe has an overflow port; and means for converting the drain assembly for use in a second application in which a sink does not have an overflow channel, wherein the means for converting the drain assembly is a second drain pipe that does not have an overflow port, and wherein the second drain pipe connects directly or indirectly to the drain flange or is formed integral with a second drain flange.

15. A kit containing parts for plumbing a sink to drain water from the sink through a drain opening, the kit comprising:

a pop-up drain assembly that includes a drain pipe that has overflow ports, a drain stopper and a pivot rod for moving the drain stopper between open and closed positions; and a sleeve that fits inside the drain pipe and covers the overflow ports in the drain pipe so that the pop-up drain assembly can be used in a sink that does not have an overflow channel, wherein the sleeve has a pivot rod port through which the pivot rod can pass.

16. A kit containing parts for plumbing a sink to drain water from the sink through a drain opening, the kit comprising:

a push-type drain assembly that includes a drain body designed and configured for receipt in the drain opening, an open-close mechanism, wherein the drain body and the open-close mechanism are designed and configured so that the open-close mechanism can be received in the drain body, and a cap or a push button engaged with the open-close mechanism; and a sleeve that fits around and surrounds a portion of an open-close mechanism and prevents the open-close mechanism from moving from an open position to a closed position.

17. The kit of claim 16, wherein the kit further comprises a second sleeve that fits inside the drain assembly for covering an overflow port.

18. A kit containing parts for plumbing a sink to drain water from the sink through a drain opening, the kit comprising:

a push-type drain assembly that includes a drain body designed and configured for receipt in the drain opening, an open-close mechanism, wherein the drain body and the open-close mechanism are designed and configured so that the open-close mechanism can be received in the drain body, and a cap or a push button engaged with the open-close mechanism; and a C-clip that fits around a portion of the open-close mechanism and prevents the open-close mechanism from moving from an open position to a closed position.

19. The kit of claim 18, wherein the kit further comprises a sleeve that fits inside the drain assembly for covering an overflow port.

20. A kit containing parts for plumbing a sink to drain water from the sink through a drain opening, the kit comprising:

a push-type drain assembly that includes a drain body designed and configured for receipt in the drain opening, an open-close mechanism, wherein the drain body and the open-close mechanism are designed and configured so that the open-close mechanism can be received in the drain body, a push button engaged with the open-close mechanism for moving the open-close mechanism between open and closed positions, and an annular cap that surrounds the push button; and a solid cap designed and configured to replace the annular cap and to cover the push button for preventing a person from pushing the push button to place the push-type drain assembly in a closed position.

21. The kit of claim 20, wherein the kit further comprises a sleeve that fits inside the drain assembly for covering an overflow port.

22. A kit containing parts for plumbing a sink to drain water from the sink through a drain opening, the kit comprising:

a push-type drain assembly that includes a drain body designed and configured for receipt in the drain opening, an open-close mechanism, wherein the drain body and the open-close mechanism are designed and configured so that the open-close mechanism can be received in the drain body, a push button engaged with the open-close mechanism for moving the open-close mechanism between open and closed positions, and an annular cap that surrounds the push button; and a cap cover designed and configured to cover the push button and the annular cap for preventing a person from pushing the push button to place the push-type drain assembly in a closed position.

23. The kit of claim 22, wherein the kit further comprises a sleeve that fits inside the drain assembly for covering an overflow port.

* * * * *